US007273390B2

(12) United States Patent
Iida et al.

(10) Patent No.: US 7,273,390 B2
(45) Date of Patent: Sep. 25, 2007

(54) CONNECTOR ASSEMBLY

(75) Inventors: Mitsuru Iida, Yokohama (JP); Hirohisa Tanaka, Tsu (JP); Kenji Jounen, Matsusaka (JP); Kousuke Yoshioka, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/556,073

(22) PCT Filed: Feb. 17, 2005

(86) PCT No.: PCT/JP2005/002447

§ 371 (c)(1),
(2), (4) Date: Nov. 9, 2005

(87) PCT Pub. No.: WO2005/083850

PCT Pub. Date: Sep. 9, 2005

(65) Prior Publication Data

US 2006/0276075 A1 Dec. 7, 2006

(30) Foreign Application Priority Data

Mar. 1, 2004 (JP) ..... 2004-056708

(51) Int. Cl.
*H01R 12/24* (2006.01)

(52) U.S. Cl. ..... 439/494; 439/660; 439/357

(58) Field of Classification Search ..... 439/494, 439/499, 492, 660, 74, 439, 357
See application file for complete search history.

(56) References Cited

U.S. PATENT DOCUMENTS 3,601,768 A * 8/1971 Lightner ..... 439/459
4,820,175 A 4/1989 Hasegawa et al.
5,525,072 A 6/1996 Kunishi
5,997,361 A * 12/1999 Driscoll et al. ..... 439/701
6,575,773 B1 6/2003 Takeuchi
6,860,755 B2 * 3/2005 Wang et al. ..... 439/498

FOREIGN PATENT DOCUMENTS

JP 55-144666 11/1980

(Continued)

*Primary Examiner*—Phuong Dinh
(74) *Attorney, Agent, or Firm*—Rader, Fishman & Grauer PLLC

(57) ABSTRACT

This connector assembly comprises a header 1 to which a plurality of coaxial cables 3 are connectable and a socket 2 configured to be mounted on a printed board 4. The header 1 can be detachable coupled to the socket 2. The header 1 has a first terminal array 12 to which the coaxial cables 3 are electrically connectable. The socket 2 has a second terminal array 21 which makes contact with the first terminal array 12 when the header 1 is coupled to the socket 2. The first terminal array has a plurality of first terminals each having a wire terminal 120 for connection with each conductive wire of the cables and a contact 122 for contact with the second terminal array. The feature of the present invention resides in that the wire terminals 120 are arranged in a line, and the contacts 122 of the first terminal array are arranged in two rows in a staggered configuration, and a pitch of the contacts 122 of each row is larger than a pitch of the wire terminals 120.

4 Claims, 8 Drawing Sheets

FOREIGN PATENT DOCUMENTS

| | | | |
|---|---|---|---|
| JP | 59-25187 | | 2/1984 |
| JP | 61-248375 | A1 | 11/1986 |
| JP | 4-129486 | | 11/1992 |
| JP | 07-272803 | | 10/1995 |
| JP | 8-264239 | | 10/1996 |
| JP | 11-307187 | | 11/1999 |
| JP | 2001-102119 | | 4/2001 |

* cited by examiner

CONNECTOR ASSEMBLY

TECHNICAL FIELD

The present invention relates to a connector assembly for electrical connection between cables and a substrate.

BACKGROUND ART

Japanese Non-examined Patent Publication No. 11-307187 discloses a connector assembly for electrical connection between cables and a substrate.

This connector assembly comprises a header to which a plurality of cables are electrically connectable and a socket configured to be mounted on a substrate.

The header can be coupled to the socket. The header has a first terminal array to which cables are connectable. The socket has a second terminal array which makes contact with the first terminal array when the header is coupled to the socket. The second terminal array includes lead terminals for mounting the socket on the substrate, and the second terminal array is electrically connected to an electric circuit on a substrate through the lead terminals. When the header is coupled to the socket, the first terminal array comes in contact with the second terminal array, whereby the cables are electrically connected to the electric circuit on the substrate.

In this connector assembly, because the first terminal array is arranged in a row on one side of the header, a pitch of the first terminal array is equal to a pitch of the cables. Therefore, when a pitch of the cables becomes small, the pitch of the first terminal array and a pitch of the second terminal array, which corresponds to the first terminal array, also become small, and therefore it becomes difficult to manufacture and mount the connector assembly. Especially, it is difficult to manufacture a contact mechanism for bringing the first terminal array into contact with the second terminal array with a minimum pitch.

DISCLOSURE OF THE INVENTION

In view of the above problem, the object of the present invention is to provide a connector assembly which can be easily manufactured and be mounted on a substrate even if a pitch of the cables is small.

A connector assembly in accordance with the present invention comprises a header and a socket. The header has a first terminal array to which a plurality of cables are electrically connectable. The socket is configured to be coupled with the header and it has a second terminal array which comes in contact with the first terminal array when the header is coupled to the socket. The first terminal array has a plurality of first terminals each having a wire terminal for connection with each conductive wire of the cables and a contact for contact with second terminal array. The feature of the present invention resides in that the wire terminals of the first terminal array are arranged in a line, and the contacts of the first terminal array are arranged in two rows in a staggered configuration, and a pitch of the contacts of each row is larger than a pitch of the wire terminals. In the connector assembly of the present invention, because the contacts of the first terminal array are arranged in two rows in a staggered configuration and the pitch of the contacts of each row is larger than that of the wire terminals, the pitch of the contacts of each row becomes large even if the pitch of the wire terminals (namely, the pitch of the cables) is small. So, it is easy to manufacture the connector assembly.

Furthermore, because the wire terminals of the first terminal array are arranged in a line, it is possible to solder the conductive wires of the cables to the wire terminals by a length of wire solder at a time. Therefore, it is easy to connect the cables to the first terminal array.

Preferably, the second terminal array has a plurality of second terminals each having a lead terminal for mounting the socket on a substrate, and the lead terminals of the second terminal array are arranged in two rows in a staggered configuration on both sides of the socket. In this case, a pitch of the lead terminals of each row can be increased, so that it becomes easy to mount the socket on the substrate. Or, each of the lead terminals can be formed larger to increase joint strength between the socket and the substrate and to increase mount reliability. The lead terminals may be arranged in two rows in a staggered configuration on one side of the socket.

The socket may be mounted on a printed board, and the header may be configured to be connected to the socket in parallel with the printed board.

As to a method for manufacturing the connector assembly in accordance with the present invention, the method preferably comprising the steps of:

(a) forming the first terminals in a comb shape on a hoop material, each contact of the first terminals being connected to the hoop material and each wire terminal of the first terminals being a free end;

(b) opposing two hoop materials formed in the step (a), and arranging them so that the wire terminals of each hoop material are arranged in a line alternately and the contacts of each hoop material are arranged in two rows in a staggered configuration, and insert-molding the first terminals in the body while exposing the wire terminals and the contacts outside the body;

(c) cutting off each hoop material from said first terminals.

By using this method, it becomes easy to manufacture the header of the connector assembly of the present invention.

BEST MODE FOR CARRYING OUT THE INVENTION

Hereinafter, the present invention will be described in more detail with reference to the accompanying drawings.

FIRST EMBODIMENT

Figure 1:
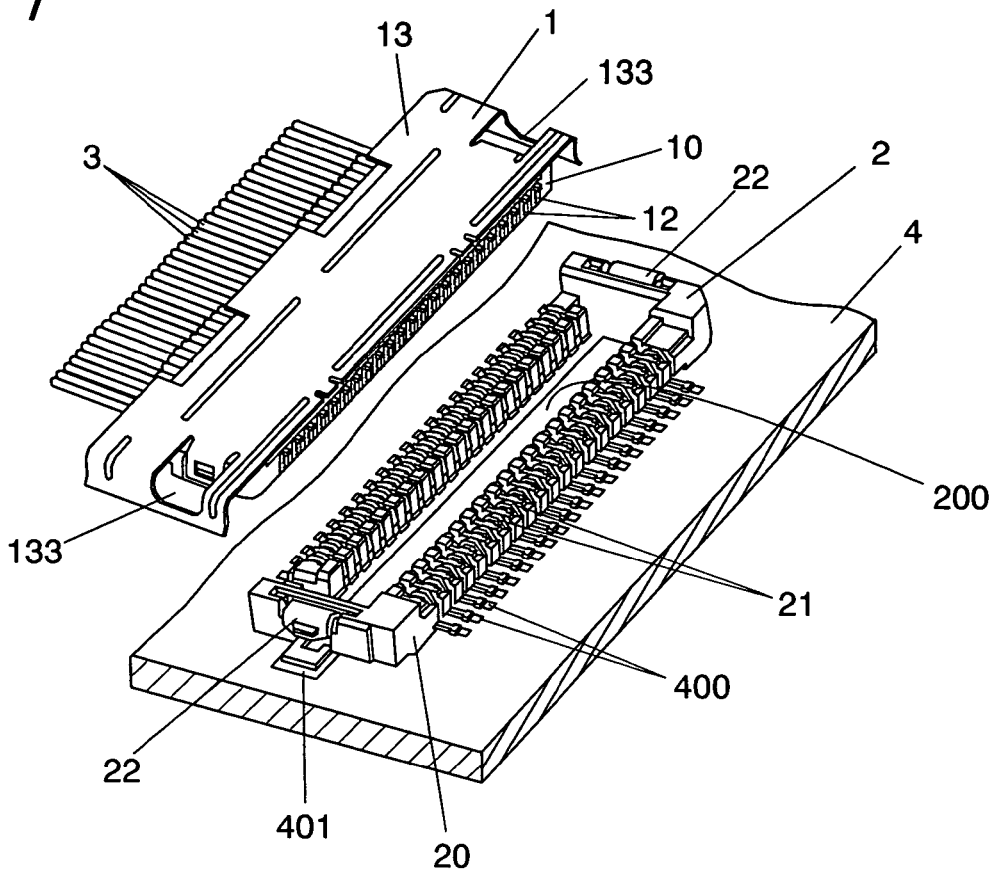
FIG. 1 is a perspective view of a connector assembly in accordance with a first embodiment of the present invention.
Figure 2:
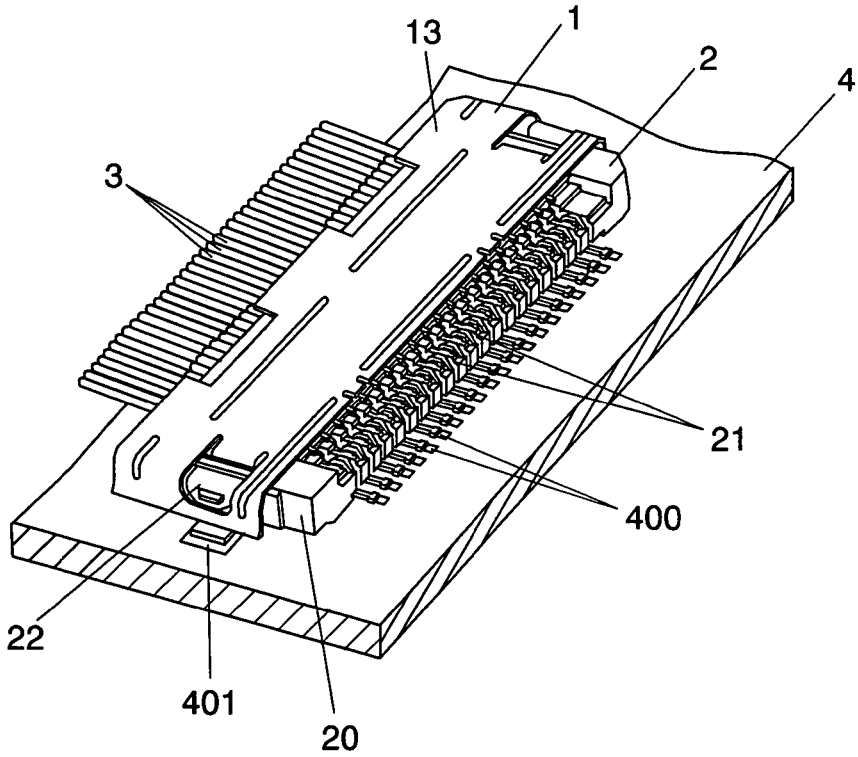
FIG. 2 is a perspective view of the connector assembly coupled to each other.

FIG. 1 shows a connector assembly in accordance with a first embodiment of the present invention. This connector assembly comprises a header 1 to which a plurality of coaxial cables 3 are connectable and a socket 2 configured to be mounted on a printed board 4. The header 1 can be detachably coupled to the socket 2. This connector assembly is for connecting the coaxial cables 3 to an electric circuit (not shown) on the printed board 4 by coupling the header 1 to the socket 2, as shown in FIG. 2.

Figure 3:
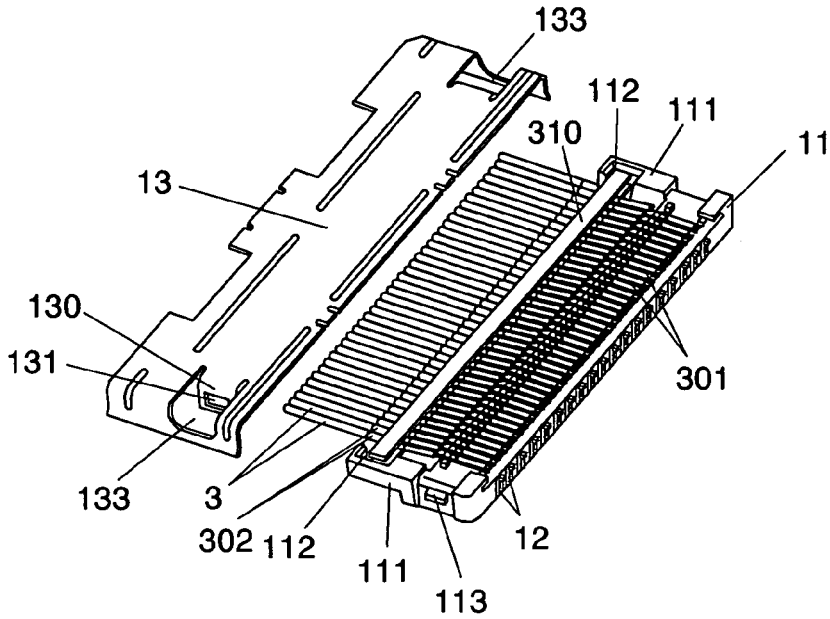
FIG. 3 is an exploded perspective view of a header of the connector assembly of FIG. 1.
Figure 4:
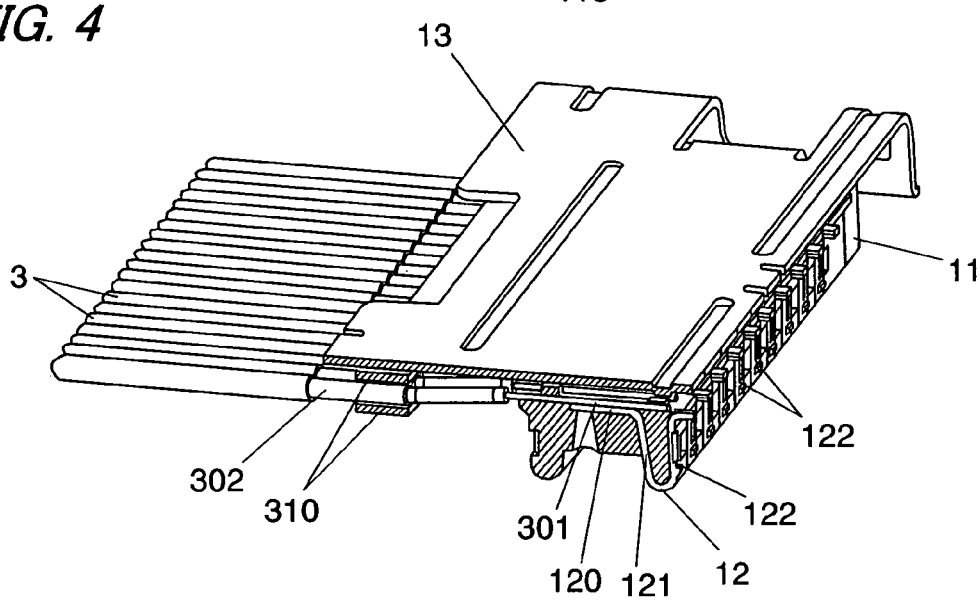
FIG. 4 is a cross sectional perspective view of the header of the connector assembly of FIG. 1.
Figure 5:
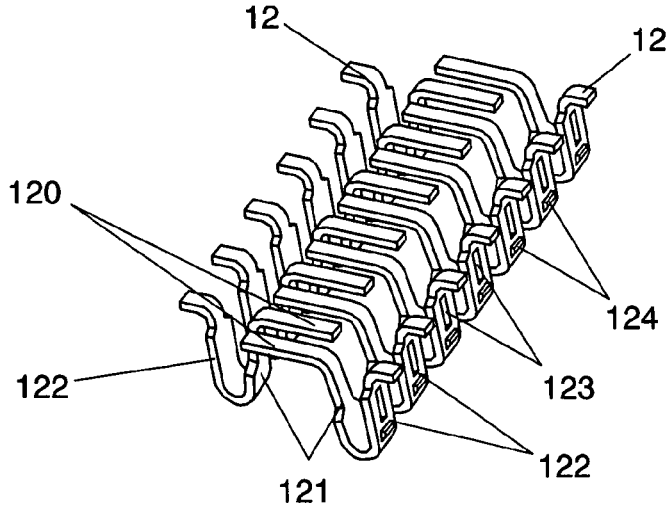
FIG. 5 is a perspective view of a first terminal array of the connector assembly of FIG. 1.
Figure 6:
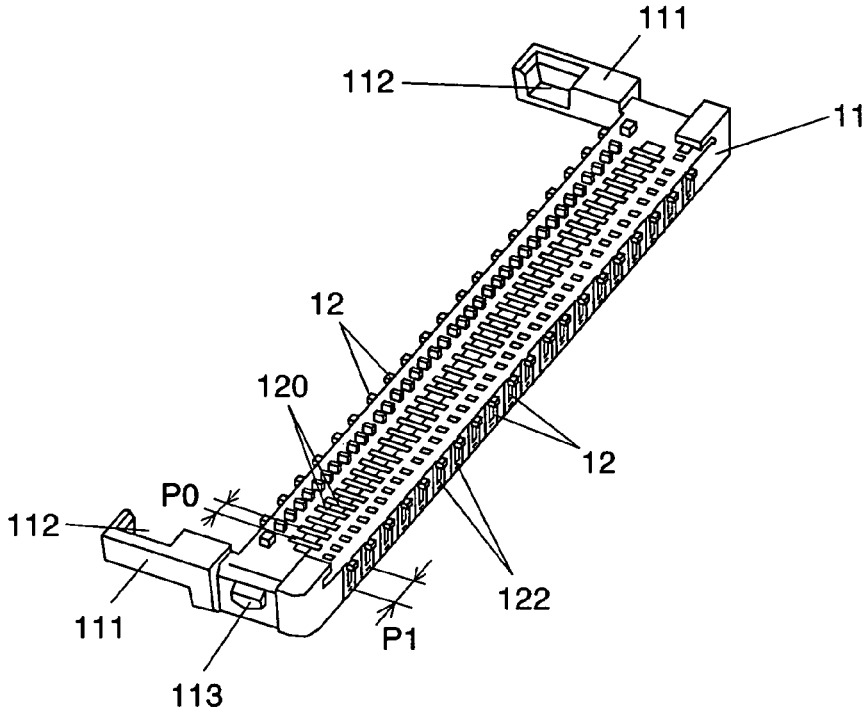
FIG. 6 is a perspective view of a body of the connector assembly of FIG. 1 in which the first terminal array was insert-molded.

As shown in FIGS. 3 to 4, the header 1 comprises a rectangular parallelepiped shaped body 11 made of a synthetic resin, a first terminal array (12, 12, . . . ) insert-molded into the body 11 and a shell 13 for covering an upper surface of the body 11 to block electromagnetic noise. The coaxial cables 3 are electrically connected to the first terminal array. As shown in FIG. 5. the first terminal array is composed of a plurality of first terminals 12. Each first terminal 12 is made of a conductive material such as metal, and it has a slender and rectangular wire terminal 120 to which each conductive wire 301 of the cables 3 is soldered, a connection piece 121 extending downward from one end of the wire terminal 120, and a contact 122 upstanding from an end of the connection piece 121. The first terminals 12 are arranged while being turned 180 degrees horizontally in turn so that the wire terminals 120 are arranged in a line and the contacts 122 are arranged in two rows, and, as shown in FIG. 6, the first terminals 12 are insert-molded into the body 11 while exposing the wire terminals 120 and the contacts 122 outside the body 11. As a result, the wire terminals 120 are arranged in a line on the upper surface of the body 11 and the contacts 122 are arranged in two rows in a staggered configuration on both longitudinal sides of the body 11. As shown in FIG. 6, because the contacts 122 are arranged in two rows in a staggered configuration, a pitch P1 of the contacts 122 on each side of the body 11 becomes twice as large as a pitch P0 of the wire terminals 120 (namely, a pitch of the coaxial cables 3). For example, when the pitch P0 of the wire terminals 120 is 0.3 mm, the pitch P1 of the contacts 122 is 0.6 mm. Therefore, even if the pitch of the cables is small because of a small diameter of the coaxial cables 3, the pitch of the contacts 122 is large, whereby it becomes easy to manufacture the header 1.

Figure 7:
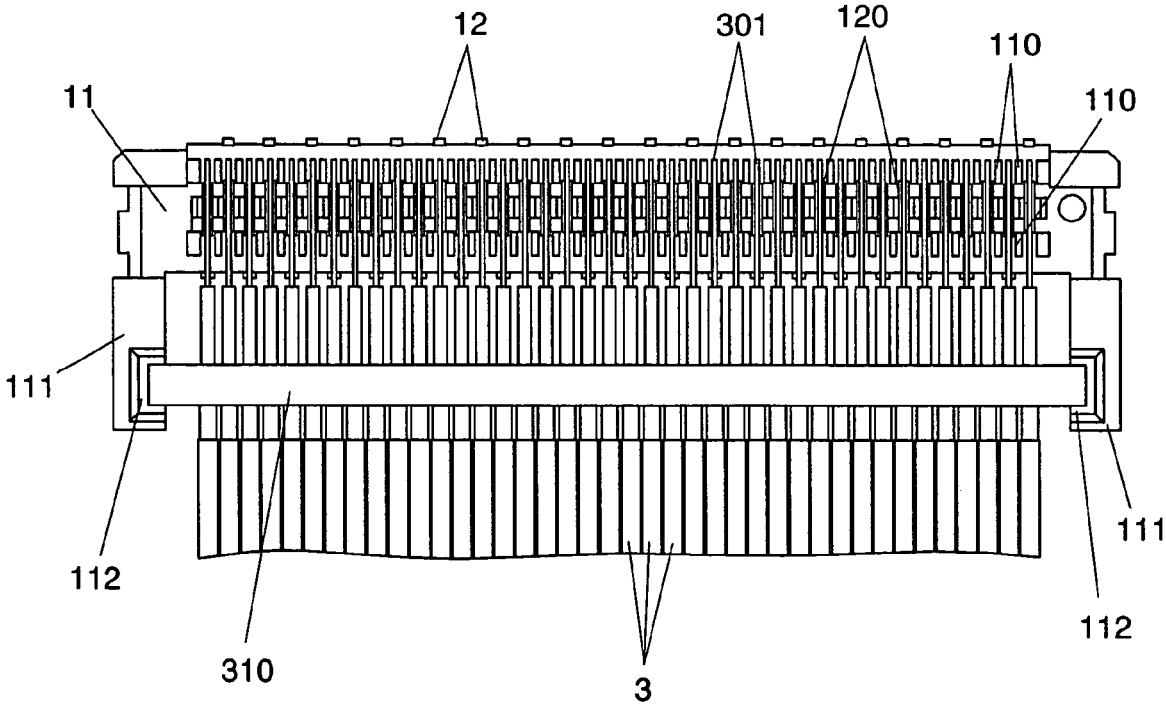
FIG. 7 is a view showing the body of the connector assembly of FIG. 1 on which cables are placed.
Figure 8:
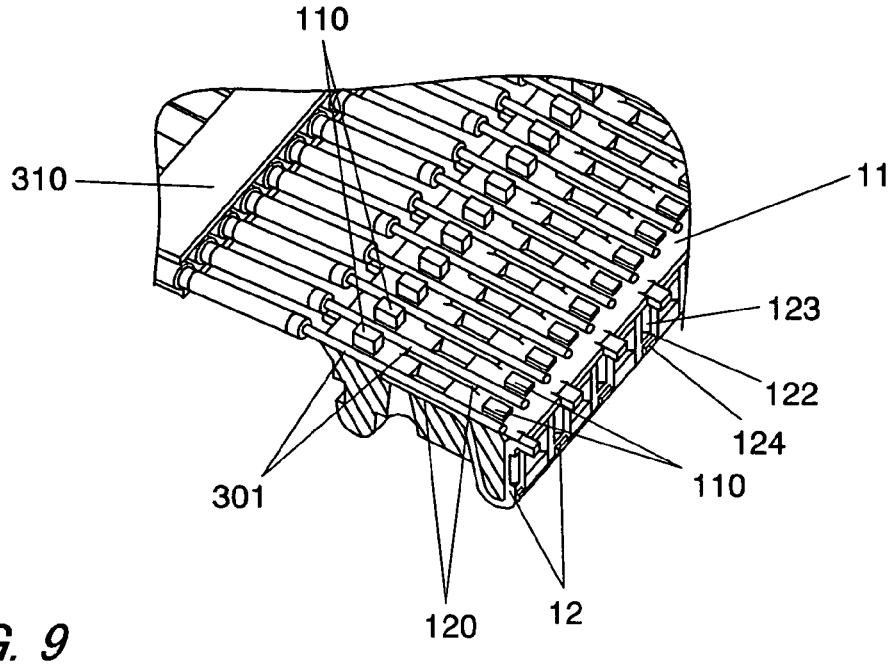
FIG. 8 is an enlarged cross sectional perspective view of FIG. 7.
Figure 9:
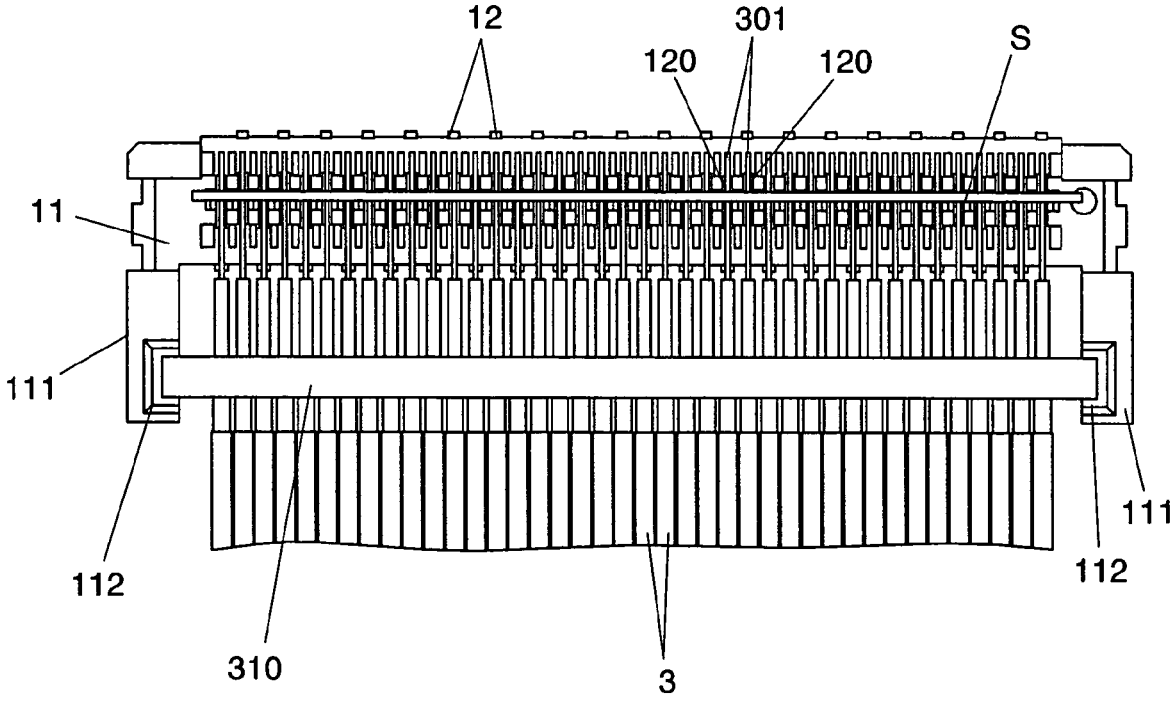
FIG. 9 is a view for explaining a method for manufacturing the header of the connector assembly of FIG. 1.

As shown in FIG. 7, the coaxial cables 3 are arranged along a longitudinal direction of the body 11, and as shown in FIG. 8, each of the conductive wires 301 are put on the wire terminals 120 exposed on the upper surface of the body 11. On the upper surface of the body 11, positioning protrusions 110 are formed near four corners of the wire terminals 120 to guide the conductive wire 301 straightly on the wire terminals 120. Then, as shown in FIG. 9, a length of wire solder S is put on the conductive wires 301 along the longitudinal direction of the body 11, and every conductive wire 301 and the corresponding wire terminals 120 are soldered at a time. It should be noted that because wire terminals 120 are arranged in a line on the upper surface of the body 11 even though the contacts 122 are arranged in two rows in the staggered configuration, every conductive wire 301 can be soldered to the corresponding wire terminals 120 at a time.

As shown in FIG. 3, ground bars 310 are soldered on and underneath the braided wires 302 of the coaxial cables 3, and both ends of each ground bar 310 are housed in recesses 112 formed in arms 111 projecting from both ends of the body 11. As will be described later, the ground bars 310 are earthed via the shell 13 and the socket 2.

Figure 10:
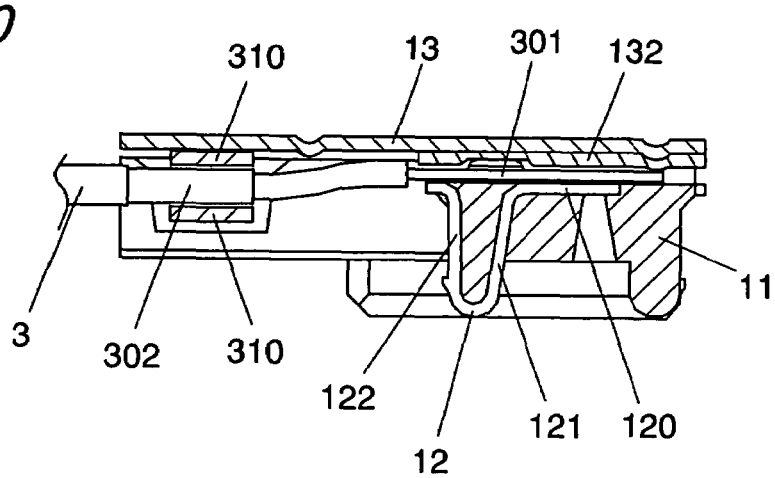
FIG. 10 is a cross sectional view of the header of the connector assembly of FIG. 1.

The shell 13 is formed by stamping and bending a metal sheet. As shown in FIG. 3, the shell 13 has coupling pieces 130 near both longitudinal ends thereof formed by cutting the shell 13 and bending cut pieces downward. Each coupling piece 130 has a first hole 131, and the shell 13 is secured to the body 11 by engaging coupling protrusions 113 formed at both longitudinal ends of body 11 in the first holes 131. When the shell 13 is secured to the body 11, the ground bar 310 comes into contact with the shell 13, and therefore they are electrically connected to each other. As shown in FIG. 10, in order to prevent electrical connection between the conductive wires 301 and the shell 13, an insulating tape 132 is affixed to the undersurface of the shell 13 which faces to the conductive wires 301 of the coaxial cables 3.

Figure 11:
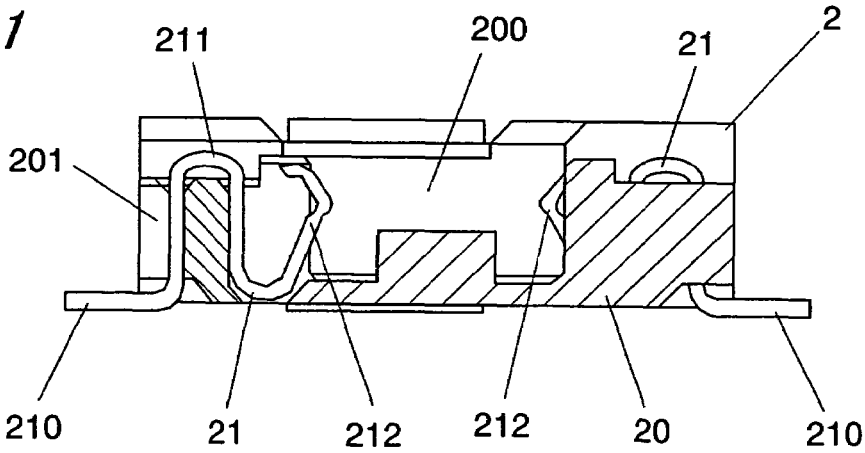
FIG. 11 is a cross sectional view of the socket of the connector assembly of FIG. 1.
Figure 12:
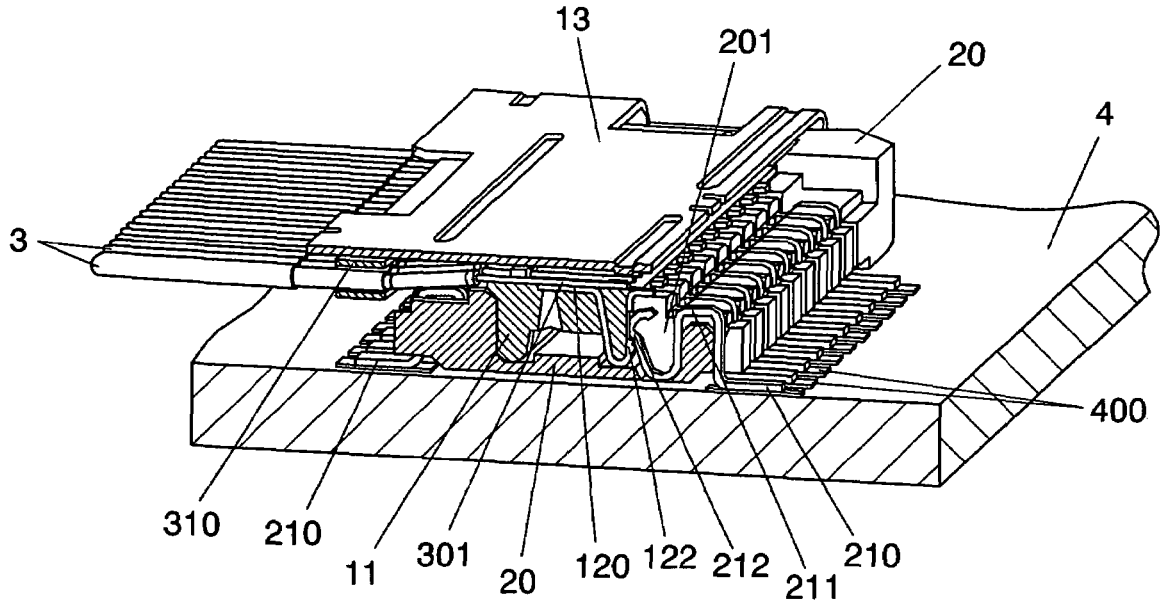
FIG. 12 is a cross sectional perspective view of the connector assembly of FIG. 2.
Figure 13:
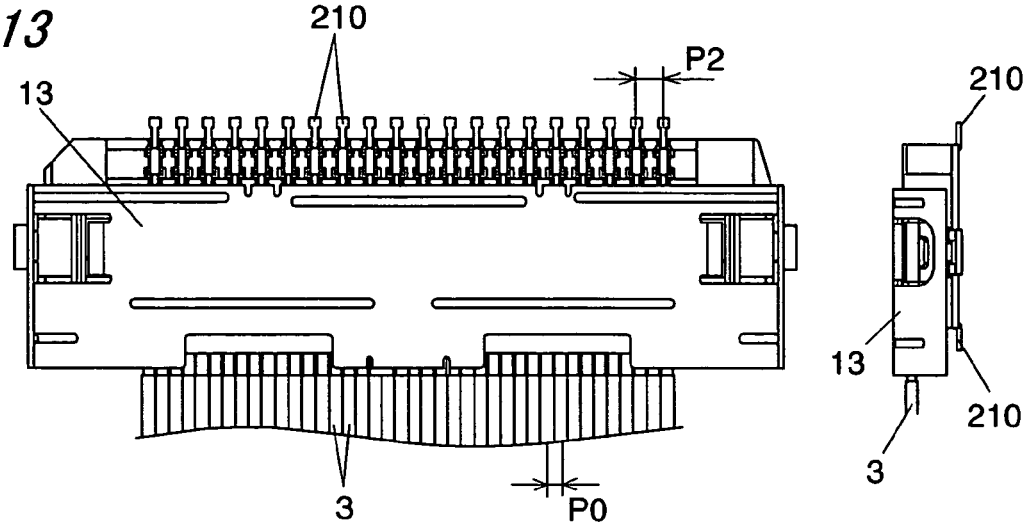
FIG. 13 is a plan view and a side view of the connector assembly of FIG. 1.

Turning back to FIG. 1, the socket 2 comprises a housing 20 having a recess 200 in which the body 11 of the header 1 can be inserted and a second terminal array (21, 21, . . . ) held by the housing 20. The housing 20 has attachment brackets 22 made of conductive material at both longitudinal ends, which are connected to a ground pad 401 on the printed board 4 respectively. The second terminals array has a plurality of second terminals 21, and they are arranged in two rows in a staggered configuration on both sides of the housing 20 along a longitudinal direction of the recess 200 so that they can come in contact with the first terminals 12 of the first terminal array when the body 11 is inserted into the recess 200. As shown in FIG. 11, each second terminal 21 has a lead terminal 210 for mounting the socket 2 on pads 400 on the printed board, an inverted U-shaped connection piece 211 extending from one end of the lead terminal 210, and a contact 212 upstanding from an end of the connection piece 211 and having elasticity. As shown in FIGS. 11 and 12, the inverted U-shaped connection piece 211 is pressed into a groove extending from an inner wall of the recess 200 to an external surface of the housing 20 to be secured to the housing 20, and the lead terminal 210 projects outward from the undersurface of the housing 20, and the contact 212 projects inside the recess 200. As shown in FIG. 13, because the second terminals 21 are arranged in two rows in a staggered configuration to make contact with the first terminals 12, a pitch P2 of the lead terminals 210 and the contacts 212 on each side of the housing 20 becomes twice as large as the pitch P0 of the wire terminals 120 (namely, the pitch of the coaxial cables 3). For example, when the pitch P0 of the wire terminals 120 is 0.3 mm, the pitch P2 of the contacts 212 and the lead terminals 210 of the second terminal array is 0.6 mm. Therefore, even if the pitch of the cables is small because of a small diameter of the coaxial cables, the pitch of the contacts 212 becomes large, whereby it becomes easy to manufacture the socket 2. Furthermore, because the pitch of the lead terminals 210 is large, it is easy to position the socket 2 on the printed board 4, and it is easy to solder the lead terminals 210 on the printed board 4. Each of the lead terminals 210 may be formed larger to increase joint strength between socket 2 and the substrate 4 and to increase mount reliability.

When the header 1 is inserted into the socket 2 (in other words, when the body 11 is inserted into the recess 200), the attachment brackets 22 are engaged in second holes 133 formed at both ends of the shell 13, so that the header 1 is secured to the socket 2. And, each contact 122 of the first terminal array 12 comes in contact with each corresponding contact 212 of the second terminal array 21, whereby the conductive wires 301 of the coaxial cables 3 are electrically connected to the electric circuit on the printed board 4 via the first terminal array, the second terminal array, and the pads 400. Further, the ground bar 310 is electrically connected to the attachment brackets 22 by the connection between the shell 13 and the attachment brackets 22, whereby the braided wires 302 of the coaxial cables 3 are earthed via the ground bar 301, the shell 13, the attachment brackets 22, and the ground pads 401. As shown in FIG. 5, the contact 122 of the first terminal 12 of this embodiment has a hole 123 and a protrusion 124, and as shown in FIG. 12, when the header 1 is coupled to the socket 2, a part of the contact 212 of the second terminal 21 is engaged into the hole 123 located above the protrusion 124 to increase the joint strength between the header 1 and the socket 2.

As mentioned above, in this connector assembly, because the contacts 122 of the first terminal array 12 and the contacts 212 of the second terminal array 21 are arranged in two rows in a staggered configuration, the pitch of the contacts of each row and the pitch of the lead terminals is twice as large as the pitch of the cables, whereby it is easy to manufacture and mount the connector assembly. Furthermore, because the wire terminals 120 are arranged in a line on the upper surface of the body 11, it is possible to solder every coaxial cable 3 to the wire terminals 120 at one time by a length of wire solder S. Therefore is, it is easy to connect the cables to the header.

Figure 14A:
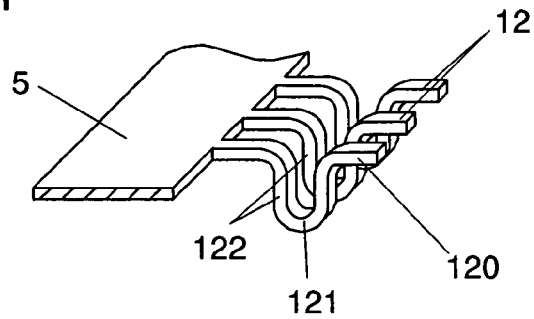
FIG. 14A is a view for explaining a method for manufacturing the connector assembly of FIG. 1.
Figure 14B:
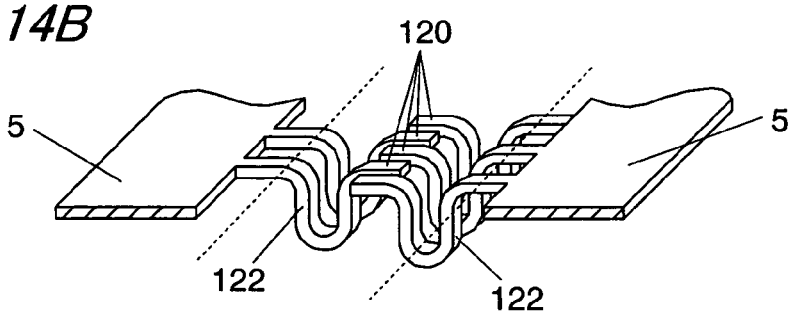
FIG. 14B is a view for explaining a method for manufacturing the connector assembly of FIG. 1.

Hereinafter, a method for manufacturing the body 11 and the first terminal array 12 will be described with reference to FIGS. 14A and 14B. In FIGS. 14A and 14B, the shape of the first terminal 12 is simplified for the sake of easy understanding. First, as shown in FIG. 14A, the first terminal array 12 is formed in a comb shape on a hoop material 5 by stamping process, bending process, and so on. The contact 122 side of each first terminal 12 is connected to the hoop material 5, and the wire terminal 120 side of each first terminal 12 is a free end. Then, as shown in FIG. 14B, two hoop materials 5 each having the connected first terminals 12 are opposed horizontally, and the two hoop materials are arranged so that the wire terminals 120 of each hoop material are arranged in a line alternately and the contacts 122 of each hoop material are arranged in two rows in a staggered configuration. In such a state, the two hoop materials 5 are insert-molded into the body 11 while exposing the wire terminals 120 and the contacts 122 outside the body 11. Lastly, the hoop materials 5 are cut off from the first terminals 12 at a position shown by a broken line of FIG. 14B. By using this method, the body 11 and the first terminal array of this embodiment can be manufactured easily.

Figure 15:
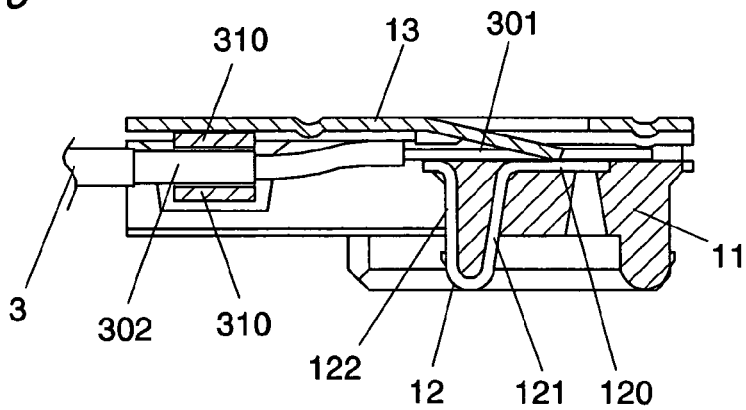
FIG. 15 is another configuration of the header of the connector assembly of FIG. 1.

Although the shell 13 was earthed via the attachment brackets 22 in this embodiment, the method for earthing the shell 13 is not limited to this. For example, as shown in FIG. 15, a part of the shell 13 may be cut and bent downward so that the shell 13 can be connected to one of the first terminals 12 electrically, and the second terminal 12 corresponding to that first terminal 12 may be connected to ground. As a result, the shell 13 can be earthed via the first terminal and the second terminal. In this case, the attachment brackets 22 become unnecessary, so that the number of parts can be reduced.

Although the coaxial cables are taken as an example in this embodiment, the cables are not limited to the coaxial cables.

SECOND EMBODIMENT

Figure 16:
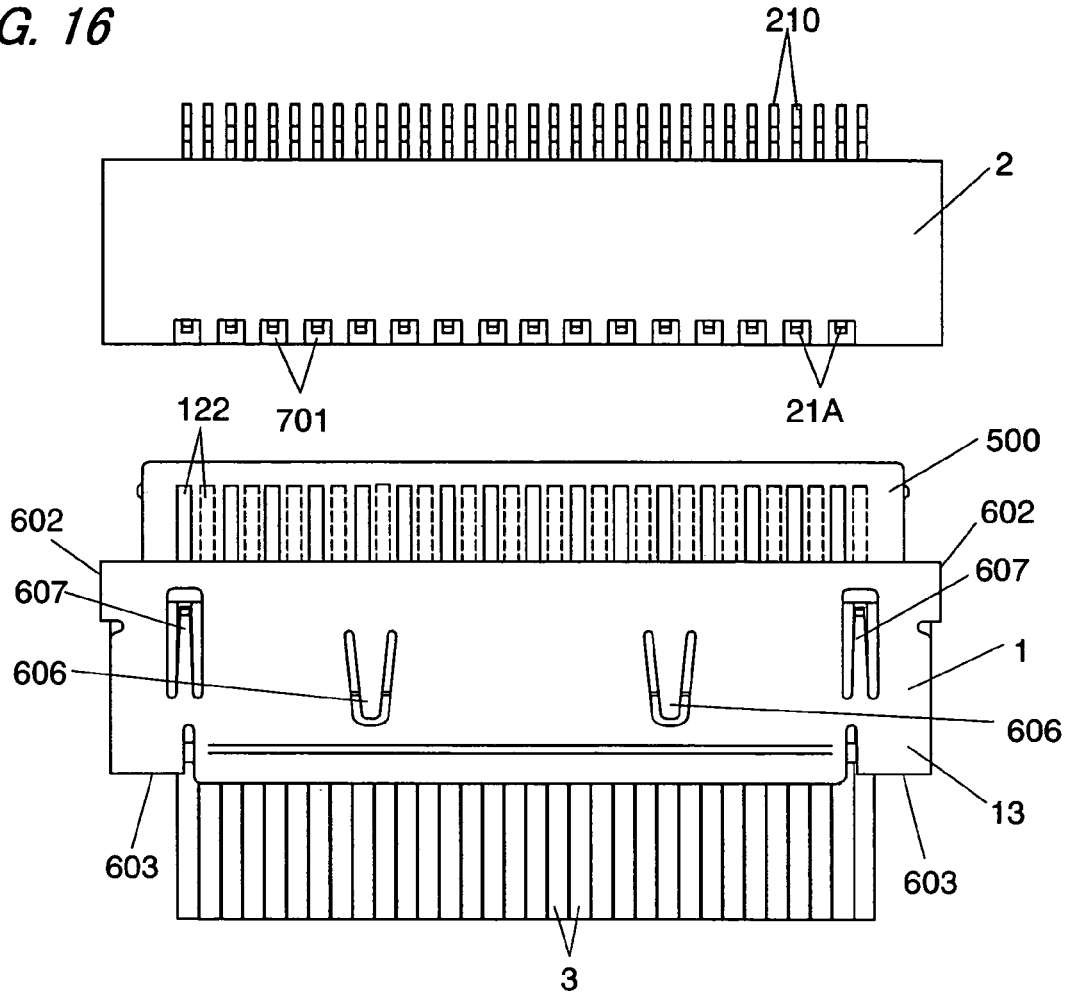
FIG. 16 is a plan view of a connector assembly in accordance with a second embodiment of the present invention.

FIG. 16 shows a connector assembly in accordance with a second embodiment of the present invention. The basic composition of this embodiment is identical to the first embodiment, so the similar part of these embodiments are identified by the same reference character and no duplicate explanation is made here. Although, in the first embodiment, the header 1 was configured to be inserted into the socket 2 vertically with respect to the printed board 4, the header 1 of this embodiment is configured to be inserted into the socket in parallel with respect to the printed board.

Figure 17:
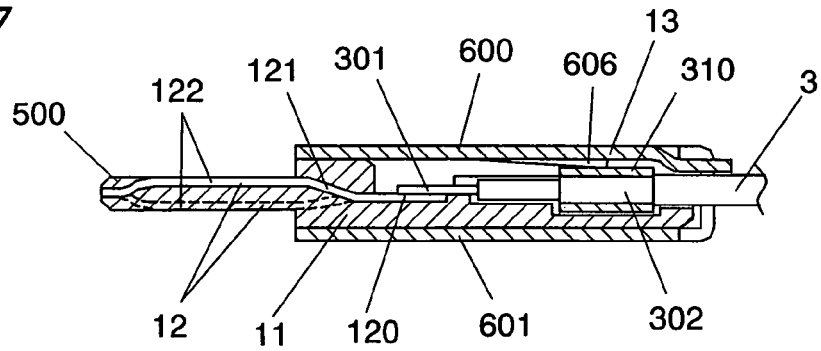
FIG. 17 is a cross sectional view of a header of the connector assembly of FIG. 16.

As shown in FIG. 16, the connector assembly of this embodiment also comprises a header 1 to which a plurality of coaxial cables 3 are connectable, and a socket 2 configured to be mounted on a printed board 4. The header 1 can be detachably coupled to the socket 2. As shown in FIG. 17, the header 1 comprises a body 11 made of a synthetic resin, a first terminal array (12, 12, . . . ) which was insert-molded into the body 11, and a shell 13 for covering an upper surface and an undersurface of the body 1 to block electromagnetic noise. The coaxial cables 3 are electrically connected to the first terminal array. The body 11 has a rectangular parallelepiped shape, and it has, along a longitudinal side face thereof, an insertion convexity part 500 to be inserted into the socket 2. The first terminal array has a plurality of first terminals 12, and each first terminal 12 has a slender and rectangular wire terminal 120, a connection piece 121 extending from one end of the wire terminal 120 in a slanting direction, and a contact 122 extending from an end of the connection piece 121 in parallel with the wire terminals 120. The first terminals 12 are arranged while being flipped vertically (a vertical direction in FIG. 17) in turn so that the wire terminals 120 are arranged in a line and the contacts 122 are arranged in two rows, and then, the first terminals 12 are insert-molded into the body 11 while exposing wire terminals 120 and the contacts 122 outside the body 11. As a result, the wire terminals 120 are arranged in a line on the upper surface of the body 11 and the contacts 122 are arranged in two rows in a staggered configuration on both the upper surface and the undersurface of the insertion convexity part 500. Because the contacts 122 are arranged in two rows in a staggered configuration, each pitch of the contacts 122 on the upper surface and the undersurface of the insertion convexity part 500 becomes twice as large as a pitch of the wire terminals 120 (namely, a pitch of the coaxial cables 3). Therefore, even if a diameter of the coaxial cables 3 is small, the pitch of the contacts 122 becomes large, whereby it becomes easy to manufacture the header 1. Furthermore, because wire terminals 120 are aligned on the upper surface of the body 11, all conductive wires 301 can be soldered to the corresponding wire terminals 120 at a time.

Figure 18:
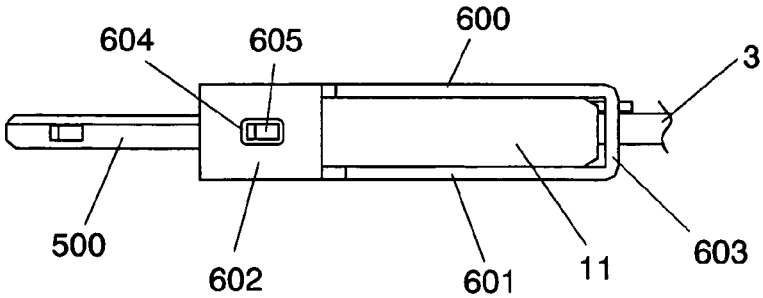
FIG. 18 is a side view of the header of the connector assembly of FIG. 16.
Figure 19:
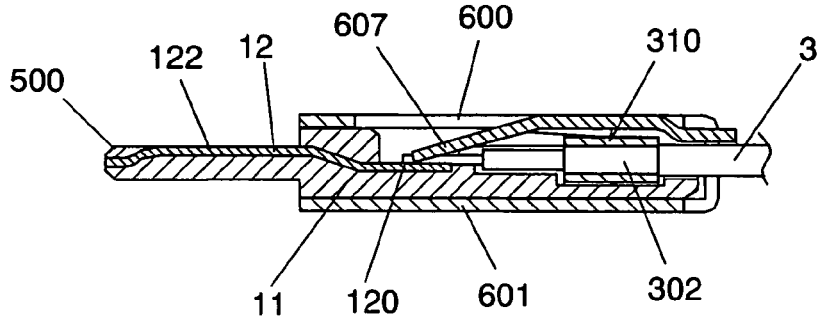
FIG. 19 is a cross sectional view of the header of the connector assembly of FIG. 16.

As shown in FIGS. 16 and 18, the shell 13 comprises an upper shell 600 for covering the upper surface of the body 11 except the insertion convexity part 500 and a lower shell 601 for covering the underside of the body 11 except the insertion convexity part 500, and the upper shell 600 and the lower shell 601 are connected to each other by first coupling pieces 602 formed at both longitudinal ends of the shell 13 and second coupling pieces 603 formed at both ends of the longitudinal side surface on the coaxial cables 3 side. The shell 13 is secured to the body 11 by engaging protrusions 605 formed at both ends of the body 11 into holes 604 formed in the first coupling pieces 602. The coaxial cables 3 are pulled out externally from between the second coupling pieces 603. As shown in FIGS. 16 and 17, the upper shell 600 has two first bent pieces 606 formed by cutting the upper shell 600 and bending cut pieces downward, and, when the shell 13 is coupled to the body 11, the tip of each first bent piece 606 comes in contact with a ground bar 310 soldered to braided wires 302 of the coaxial cables. Furthermore, the upper shell 600 has second bent pieces 607 formed by cutting the upper shell 600 and bending cut pieces downward, and, as shown in FIG. 19, when the shell 13 is coupled to the body 11, the tips of the second bent pieces 607 come in contact with the wire terminals 120 of the first terminal array 12 located at both ends of the insertion convexity part 500. Therefore, when the second terminals corresponding to the first terminals at both ends of the insertion convexity part 500 are connected to a ground line of the printed board, the braided wires 302 of the coaxial cables 3 are earthed via the ground bar 310, the first bent pieces 606, the shell 13, the second bent pieces 607, the first terminal array 12, and the second terminal array 21.

Figure 20:
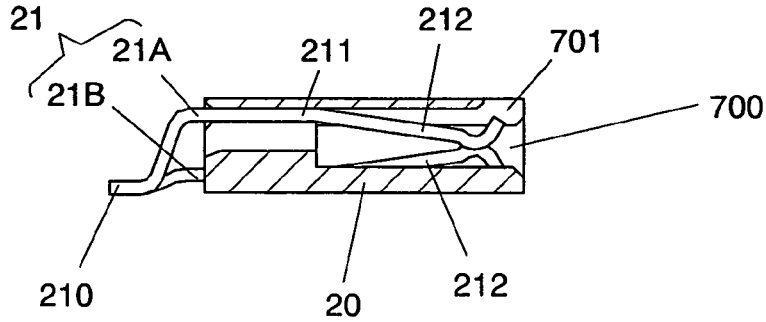
FIG. 20 is a cross sectional view of a socket of the connector assembly of FIG. 16.

As shown in FIGS. 16 and 20, the socket 2 comprises a housing 20 having a recess 700 formed in a longitudinal side surface thereof and the second terminal array 21 held by the housing 20. The insertion convexity part 500 of the header 1 can be inserted in the recess 700. The second terminal array 21 is composed of two kinds of terminals: upper terminals 21A projecting obliquely downward from an upper surface of the recess 700 so that they can make contact with the first terminals exposed on the upper surface of the insertion convexity part 500, and lower terminals 21B projecting obliquely upward from a lower surface of the recess 700 so that they can make contact with the first terminals exposed on the undersurface of the insertion convexity part 500. Each of the upper terminals 21A and the lower terminals 21B has an lead terminal 210 for mounting the socket 2 on pads 400 on the printed board, a connection piece 211 extending from one end of the lead terminal 210 and held by the housing 20, and a contact 212 extending obliquely upward or obliquely downward from an end of the connection piece 211 and having elasticity. The upper terminals 21A and the lower terminals 21B are arranged alternately so that they can make contact with the first terminal array 12 arranged in a staggered configuration on the upper surface and the undersurface of the insertion convexity part 500. Therefore, each of the pitch of the upper terminal 21A and the pitch of the lower terminal 21B becomes twice as large as the pitch of the coaxial cables 3, whereby it becomes easy to manufacture the socket 2.

Figure 21:
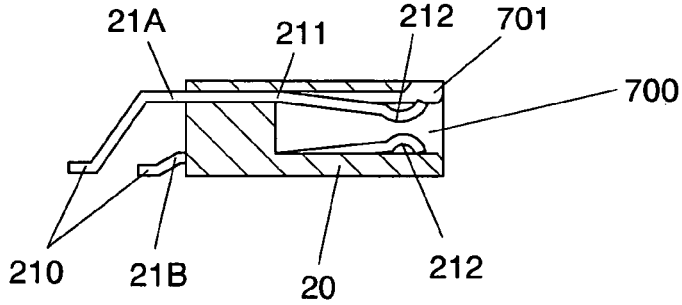
FIG. 21 is another configuration of the socket of the connector assembly of FIG. 16.

Although, as shown in FIG. 20, the lead terminals 210 are aligned on one side of the housing which is opposite to the recess 700, the lead terminals 210 may be arranged in two rows in a staggered configuration on one side of the socket 2 (namely, on one side of the housing 20), as shown in FIG. 21. In this case, the pitch of the lead terminals 210 of each row is doubled, whereby it becomes easy to position the socket 2 on the printed board 4, and it becomes easy to solder the lead terminals 210 on the printed board 4. Each of the lead terminals 210 may be formed larger to increase joint strength between the socket 2 and the substrate 4 and to increase mount reliability.

In this embodiment, as shown in FIGS. 16 and 20, notches 701 are formed in the housing 20 at points above the tips of the upper terminals 21A so that the tips of the upper terminals 21A do not get in tough with the inner surface of the housing when the insertion convexity part 500 is inserted into the recess 700.

As mentioned above, in this embodiment too, it is easy to manufacture and mount the connector assembly. And, it is possible to solder all of the coaxial cables 3 to the wire terminals 120 at the same time by a length of wire solder S.

Figure 22A:
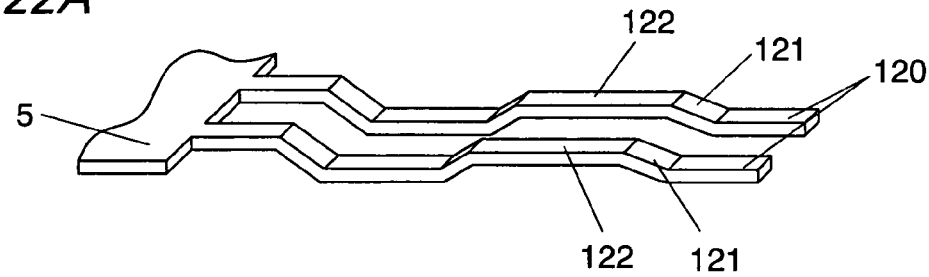
FIG. 22A is a view for explaining a method for manufacturing the header of the connector assembly of FIG. 16.
Figure 22B:
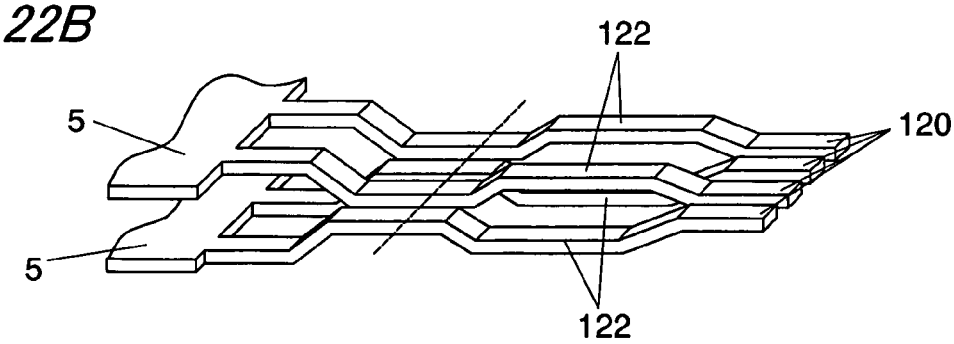
FIG. 22B is a view for explaining a method for manufacturing the header of the connector assembly of FIG. 16.

Next, a method for manufacturing the body 11 and the first terminal array 12 will be described below with reference to FIGS. 22 and 22B. First, as shown in FIG. 22A, the first terminal array 12 is formed in a comb shape on a hoop material 5 made of a metal material by stamping process, bending process, and so on. The contact 122 side of each first terminal 12 is connected to the hoop material 5, and the wire terminal 120 side of each first terminal 12 is a free end. Then, one hoop material 5 having the connected first terminals is flipped, and as shown in FIG. 22B, the two hoop materials 5 are opposed vertically, and the two hoop materials 5 are arranged so that the wire terminals 120 of each hoop material 5 are arranged in a line alternately and the contacts 122 of each hoop material 5 are arranged in two rows in a staggered configuration. In such a state, the two hoop materials 5 are insert-molded into the body 11 while exposing the wire terminals 120 and the contacts 122 outside the body 11. Lastly, the hoop materials 5 are cut off from the first terminals 12 at a position shown by a broken line of FIG. 22B. By using this method, the body 11 and the first terminal array of this embodiment can be manufactured easily.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. A connector assembly comprising:

a header having a first terminal array to which a plurality of cables are electrically connectable;

a socket configured to be coupled with said header, said socket having a second terminal array which comes in contact with said first terminal array when said header is coupled to the socket;

said first terminal array having a plurality of first terminals each having a wire terminal for connection with each conductive wire of the cables and a contact for contact with said second terminal array, wherein said header has a body for holding said first terminal array, said socket having a recess in which said is inserted, each contact of said second terminal array being disposed inside said recess, said first terminal array being insert-molded in said body so that said wire terminals and said contacts are exposed on surfaces of said body, said wire terminals of said first terminal array being arranged in a line on one surface of said body, said contacts of said first terminal array being arranged in two rows in a staggered configuration on both sides of said body, a pitch of said contacts of each row being larger than a pitch of said wire terminals.

2. The connector assembly as set forth in claim 1, wherein said second terminal array has a plurality of second terminals each having a lead terminal for mounting said socket on a substrate, said lead terminals of said second terminal array being arranged in two rows in a staggered configuration on both sides of the socket.

3. The connector assembly as set forth in claim 1, wherein said second terminal array has a plurality of second terminal each having a lead terminal for mounting said socket on a substrate, said lead terminals of said second terminal array being arranged in two rows in a staggered configuration on one side of the socket.

4. The connector assembly as set forth in claim 1, wherein said socket is configured to be mounted on a printed board, said header being configured to be connected to said socket in parallel with the printed board.

* * * * *